United States Patent [19]

Grant

[11] Patent Number: 4,736,951

[45] Date of Patent: Apr. 12, 1988

[54] GOLF CLUB

[76] Inventor: Thomas Grant, P.O. Box 11202, Selcourt, Springs, Transvaal Province, South Africa

[21] Appl. No.: 867,485

[22] Filed: May 27, 1986

[30] Foreign Application Priority Data

May 28, 1985 [ZA] South Africa ..... 85/4054
Aug. 30, 1985 [ZA] South Africa ..... 85/6668

[51] Int. Cl.[4] ..... A63B 53/06

[52] U.S. Cl. ..... 273/79; 273/80.1; 273/171

[58] Field of Search ..... 273/79, 80.1, 80.2–80.9

[56] References Cited

U.S. PATENT DOCUMENTS

| | | | |
|---|---|---|---|
| 2,155,830 | 4/1939 | Howard | 273/79 |
| 3,931,969 | 1/1976 | Townhill | 273/77 R |
| 4,073,492 | 2/1978 | Taylor | 273/80.2 |

FOREIGN PATENT DOCUMENTS

| | | | |
|---|---|---|---|
| 323821 | 1/1930 | United Kingdom | 273/80.1 |
| 381433 | 10/1932 | United Kingdom | 273/80.1 |
| 467396 | 6/1936 | United Kingdom | 273/80.1 |
| 569266 | 5/1945 | United Kingdom | 273/79 |
| 1118181 | 6/1968 | United Kingdom | 273/80.1 |
| 2137890A | 10/1984 | United Kingdom | 273/80.1 |

*Primary Examiner*—George J. Marlo
*Attorney, Agent, or Firm*—Harness, Dickey & Pierce

[57] ABSTRACT

A golfing aid is disclosed which is adjustable to suit the individual preferences of a particular golfer, the adjustments subsequently being lockable to form a customized golf club. The aid includes a club head, a shaft and a connection arrangement for connecting the lower end of the shaft to the club head. The connection arrangement includes first, second and third members. The first member is connected to the shaft while the second member is connected to the club head at a connection whose position along the club head in the toe-heel direction is adjustable. A third member is connected between the first and second members and connects them indirectly to one another. The connection of the second member to the club head permits pivotal adjustments to be made about a first axis which is transverse to the ball-striking surface of the club head. The connection between the first member and the third member permits pivotal adjustment about a second axis and the connection between the third member and the second member permits pivotal adjustments about a third axis. Either the second axis or the third axis is transverse to the first axis with the other of these axes being parallel to, but spaced from, the first axis. The result is a golfing aid which not only has provision for adjustment of the shaft-head connection along the length of the head, but also for pivotal adjustment of the shaft relative to the head about three distinct pivotal axes.

7 Claims, 4 Drawing Sheets

GOLF CLUB

This invention relates to a golfing aid.

According to the invention there is provided a golfing aid intended to permit a golf club to be custom made for a particular player, the golfing aid including a club head and connection means for connecting a shaft to the club head, the connection means having adjustment means to permit variation of the position of the club head relative to the shaft.

The connection means may include at least one pivotal connection to permit adjustment of the angle of a face of the club head relative to the shaft. The connection means may also include at least one pivotal connection to permit adjustment of the angle of the shaft relative to the club head. In a preferred embodiment the connection means includes a pair of pivotal connections providing adjustment of the angle of the shaft relative to the club head about two different axes in the same plane. The first pivotal connection then allows adjustment of the distance of the club head from a player and the second pivotal connection in the same plane allows adjustment of the balance of the club head to ensure that the club head remains at right angles to the desired path of the golf ball while the club head approaches the golf ball during a stroke.

The connection means may further include adjustable attachment means to permit adjustment of the attachment position of the shaft along the length of the club head. The attachment means may be in the form of a series of apertures in the club head each adapted to receive the connection means. In another embodiment, the attachment means may include an elongated slot with clamping means for adjustably clamping the shaft relative to the slot. The elongated slot may be dovetail shaped in end view and the clamping means may include a mating dovetail member slidably receivable in the slot.

The club head may have locating means for removably locating a plurality of different weights on the club head to permit the mass of the club head to be adjustably varied. The locating means may be in the form of a groove, eg. of fantail shape, for receiving weights of complementary shape.

A shaft may be fitted to the connection means. The shaft may then have adjustment means for varying the effective length of the shaft.

In one embodiment, the shaft may have a handle with a hollow interior and may have longitudinal slits therein. The shaft can then be inserted into the hollow interior to varying degrees. A conical nut may be provided for locking the handle onto the shaft by contracting the longitudinal slits. The attachment of the shaft to the club head may be adjustable in similar fashion.

In another embodiment, the handle may have an internal screw thread and an elongated external screw thread may be provided on the shaft with a lock nut for locking the shaft to the handle in a particular position.

Indicator means may be provided for indicating the particular positioning of the club head relative to the shaft, a particular effective length of the shaft, and so on, so that a player after experimenting with various positions, effective lengths, and so on, can record data of a preferred form of the club to permit the club to be custom built in accordance with the recorded data.

The club head may be formed from different materials having varying degrees of resilience, eg. its striking face may be of a more resilient material than the remainder of the head.

The invention extends further to a golf club manufactured from a golfing aid as above described, in which after adjustment of the club head relative to the shaft, the adjustment means are permanently locked in position to inhibit subsequent adjustment.

In another embodiment, the golfing aid itself may be converted into a golf club by encapsulating at least portion of the golfing aid to prevent subsequent adjustment of the club.

In yet another embodiment, the adjustment settings of the golfing aid may be recorded and a golf club may be manufactured in accordance with the settings as recorded.

Various embodiments of the invention are now described by way of example with reference to the accompanying drawings, in which FIG. 1 shows a schematic side elevation of a golfing aid in accordance with the invention;

Figure 1:
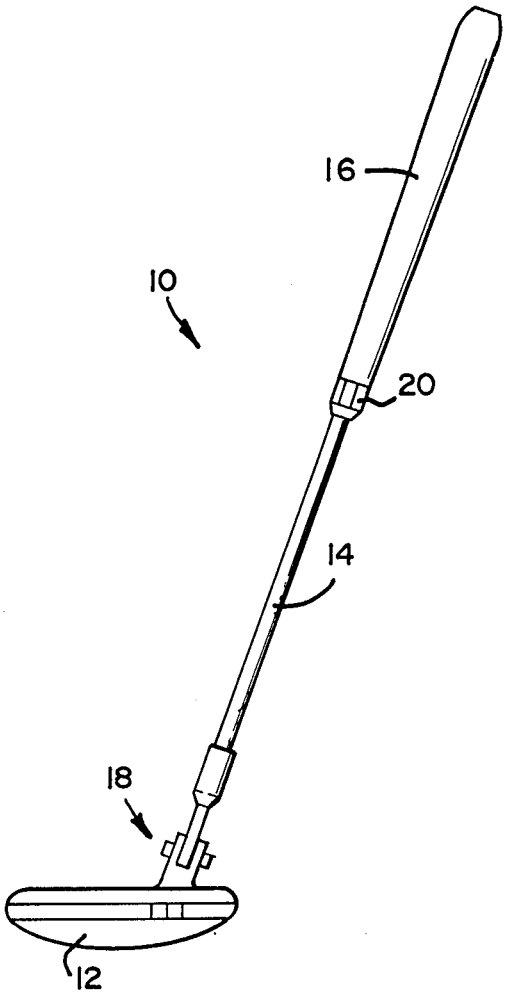

Referring to FIG. 1, reference numeral 10 generally indicates a golfing aid intended to permit a golf club to be custom made for a particular player. The golfing aid includes a club head 12, a shaft 14 and a handle 16. A pivotal connection generally indicated by reference numeral 18 is provided connecting the shaft 14 to the head 12. The effective length of the shaft 14 and handle 16 is variable by adjusting a conical lock nut 20.

Figure 2:
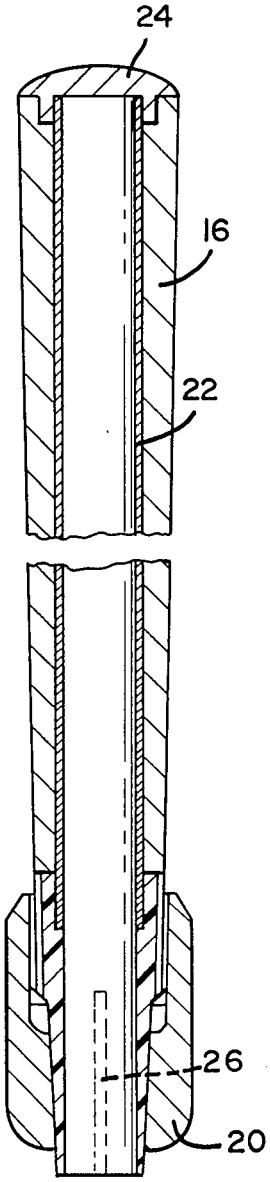
FIG. 2 shows a schematic sectional view of one means of adjusting the effective length of a shaft of the golfing aid.

The locking of the handle 16 to the shaft 14 is more clearly illustrated in FIG. 2. As shown, the handle 16 has a hollow interior fitted with an axial sleeve 22. The covering around the sleeve 22 can be varied as required by a player. The handle 16 has an end cap 24 and has axially extending slots 26 at its other end. Once the shaft 14 is inserted into the hollow interior of the handle 16 to a desired degree, the nut 20 is simply tightened thereby constricting the slots 26.

Figure 3:
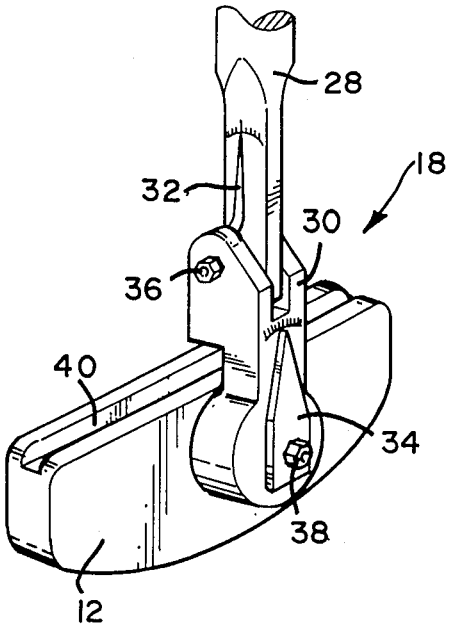
FIG. 3 shows a three dimensional view of one form of pivotal connection for connecting a club head to a shaft.

The pivotal connection 18 is shown in greater detail in FIG. 3. As shown, it includes an upper member 28 pivotally connected to a lower member 30 which in turn is pivotally connected to the club head 12. The relative positioning of the shaft 14 to the club head 12 can therefore be adjustably varied. Once a suitable position is found, the relative positioning of the upper member 28 to the lower member 30 can be recorded as indicated by an indicator needle 32. Similarly, a recording can be made of the relative positioning of the head 12 to the lower member 30 as indicated by an indicator needle 34.

During adjustment, nuts 36 and 38 are loosened and tightened as required. The nuts 36 and 38 as well as the indicator needles 32 and 34 can be countersunk in recesses (not shown) to permit a mould to be formed directly from the members 28 and 30 for forging the final golf club.

As also shown in FIG. 3, the head 12 has an elongated groove 40 formed therein which is of fantail shape. Weights of complementary shape can then be inserted in the groove 40 to permit a preferred mass to be determined. The weights may be positively located by a grub screw extending through the weight and engaging the bottom of the groove 40 thereby urging the weight outwardly from the groove 40.

Figure 4:
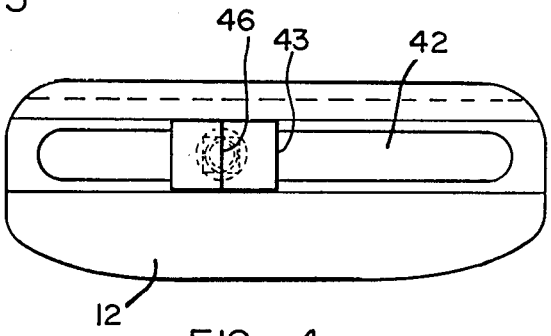
FIG. 4 shows a front view of one form of club head in accordance with the invention.
Figure 5:
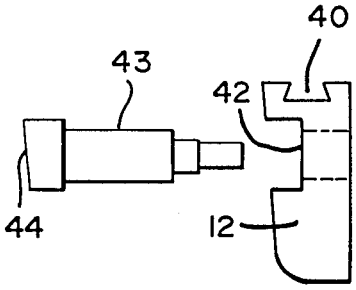
FIG. 5 shows a side view of the club head of FIG. 4.

In FIGS. 4 and 5, a modification is shown wherein the club head 12 has an elongated slot 42 formed therein so that the relative positioning of the lower member 30 to the head 12 can be varied along the length of the head 12. A locking pin 43 has a sloping face 44 corresponding to the striking face of the head 12. The striking face of the head 12 may slope in the opposite direction relative to the vertical than that shown in FIG. 5 or be exactly vertical. The lower edge of the striking face is conveniently arcuately curved as shown in FIG. 5 to minimise frictional resistance with grass when striking a golf ball. In front elevation, the head of the locking pin is rectangular and has an indicator line 46 thereon.

The lower end of the upper member 28 is flattened and this is received between a pair of jaws of the lower member 30 as shown in FIG. 3.

Figure 6:
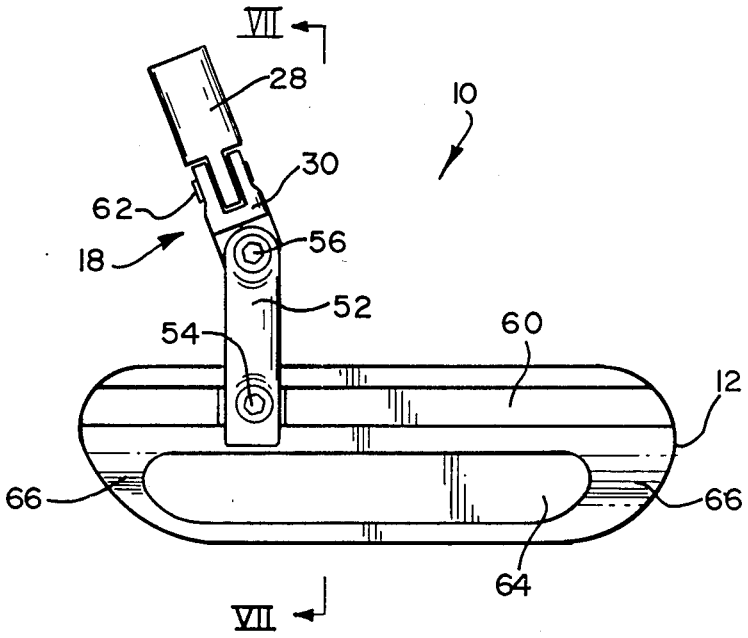
FIG. 6 shows a front view of a further form of club head and pivotal connection.
Figure 7:
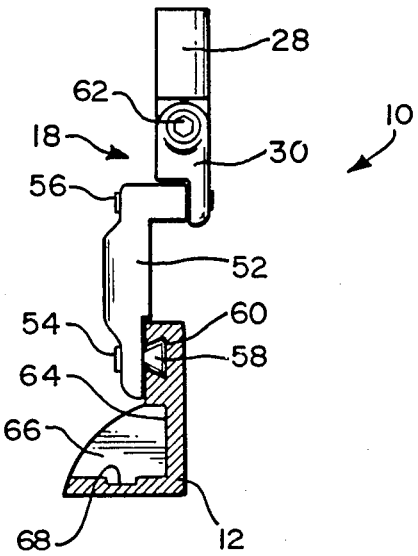
FIG. 7 shows a partly sectioned side elevation of the FIG. 6 embodiment.
Figure 8:
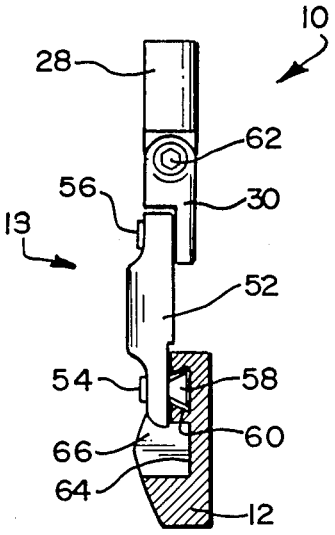
FIG. 8 shows a partly sectioned side elevation of still a further form of the club head and pivotal connection.

In FIGS. 6 to 8, the upper member 28 and lower member 30 constituting the pivotal connection 18 are supplemented by a connector member 52. The connector member 52 permits further adjustments in the same plane, ie. its pivotal position relative to the club head 12 is adjustable by a locking screw 54 and its pivotal position relative to the shaft (not shown) is adjustable by a locking screw 56.

The screw 54 draws a fantail shaped member 58 into locking engagement with a slot 60 of corresponding shape while the screw 56 locks the lower member 30 to the connector member 52. The screw 54 also permits adjustment of the position of connection of the shaft relative to the length of the club head 12.

Again a further screw 62 permits adjustment of the angle of the shaft to the club head 12 in an axis at right angles to the axes of the screws 54 and 56.

The main difference between the FIG. 8 embodiment and the FIGS. 6 and 7 embodiment is that in the former, the connector member 52 is substantially aligned in a vertical plane as seen in FIG. 8 with the lower member 30 while in the latter the connector member 52 is misaligned with the lower member as shown in FIG. 7.

In both these embodiments, the connector member 52 would normally be located so that it is vertical when in use so that a golfer while addressing a golf ball can keep the connector member vertical thereby to assist the golfer in striking the ball correctly.

The pivotal connection formed by the screw 56 allows adjustment of the distance of the club head 12 from a player. Dependent upon the position of the screw 54 along the length of the club head and the adjustment of the screw 45, the balance of the club head will be affected. Thus, the further the screw 54 is moved along the slot 60 away from a player, the more the head 12 will tend to turn inwardly when a stroke is played. The pivotal connection formed by the screw 54 thus allows further adjustment of the angle of the shaft relative to the club head 12 to compensate for imbalance of the head resulting from adjustment of the screw 54 along the length of the club head 12.

The golfing aid shown in FIGS. 6 to 8 can be converted to a golf club by encapsulating the screws 54, 56 and 62 and for this purpose the screws are conveniently countersunk and recessed to permit encapsulation, eg. by welding, soldering, brazing, or the like.

In order to prevent the mass of such encapsulation affecting the mass of the club after a particular mass has been selected, the mass of the encapsulation can be compensated for by removing a corresponding mass of material from the club, eg. from the fantail shaped member 58.

The slot 60 and a further slot 64 provide a convenient location for labels or other written material and it will be noted that when a golfer is addressing a golf ball the labels are out of his line of sight to prevent distraction by such labels.

The club head 12 preferably has bulbous portions 66 at each end providing additional mass to the club head.

As shown in FIG. 7, a slot 68 can be formed, the depth of the slot 68 varying along the length of the club head. This permits the weight distribution along the length of the club head to be varied so that when the golf club is placed on the ground while a golfer is addressing a golf ball and is in the correct stance, the club automatically assumes a position at right angles to the direction in which the ball is to be struck. The depth of the slots 64 and 60 can also be varied for the same purpose. The bulbous portions 66 also can be adjusted, eg by machining, to give a desired weight distribution.

Figure 9:
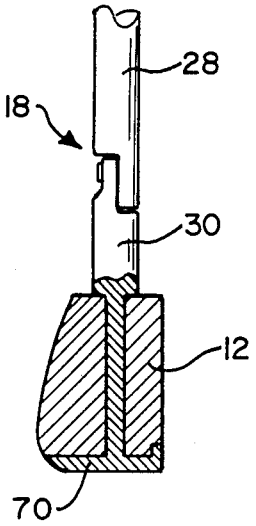
FIG. 9 shows a partly sectioned side elevation of another form of club head and pivotal connection.

In FIG. 9, a golf club is shown having a pivotal connection 18 allowing adjustment in one direction only although, adjustment about different axes as in the previous embodiments may also be provided.

In this embodiment the lower member 30 extends through the head 12 and has a base 70. The lower member 30 and base 70 can then be formed from a wear resistant material such as stainless steel while the remainder of the head 12 can be formed from a resilient material such as phosphor bronze. The remainder of the head can comprise a metal formed from about 90,7% copper, 4,4% nickel, 4,3% iron, 0,32% zinc, 0,1% tin and 0,06% phosphor, the percentage being by mass. If desired, locating formations (not shown) may be provided on the base 70 and/or on that portion of the lower member 30 which is embedded in the remainder of the head to locate the remainder rigidly on the base 70 and lower member 30.

Figure 10:
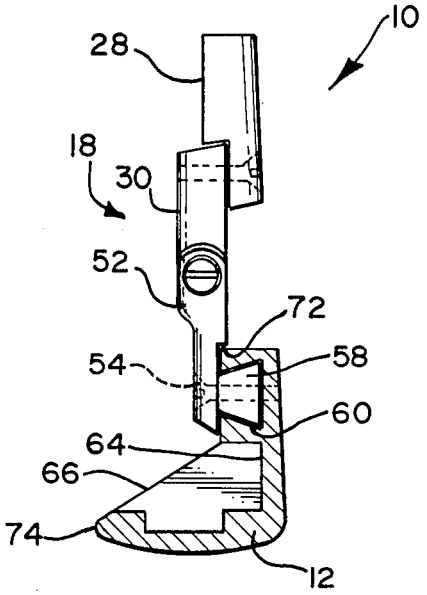
FIGS. 10 and 11 show a schematic side and front view of yet a further embodiment of the invention.
Figure 11:
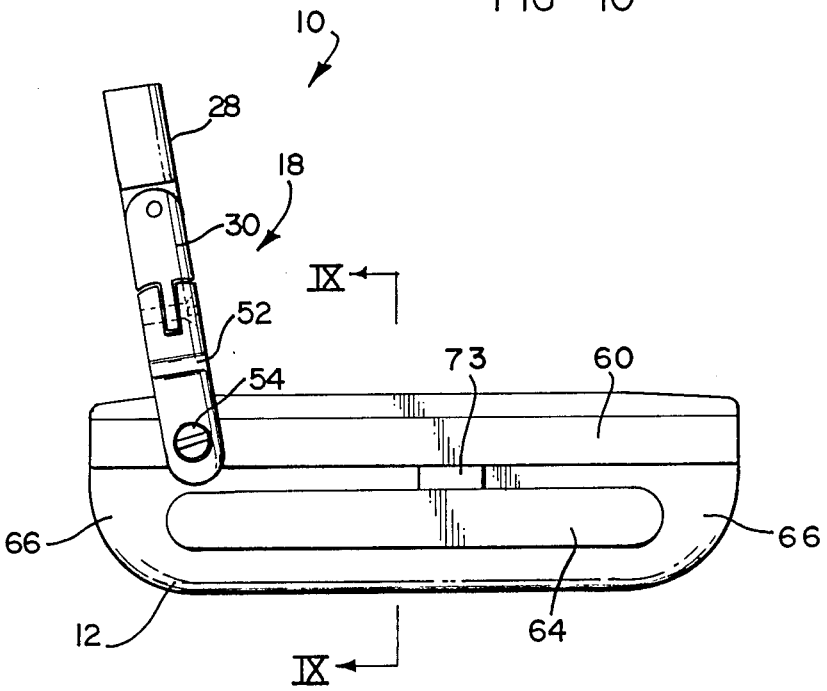

In the FIGS. 10 and 11 embodiment, a modification of the FIGS. 6 to 8 embodiments is shown. The upper member 28 is again pivotally connected to the lower member and allows adjustment of the angle of the shaft relative to the club head 12. The lower member 30 is also again pivotally connected to the connector member 52 to permit adjustment in a direction at right angles to the adjustment between the upper and lower members 28 and 30. The fantail shaped member 58 again provides adjustment of the positioning of the shaft along the length of the club head 12.

The opposing faces on the upper and lower members 28 and 30 which are in abutment can be adjusted by machining one or both of the abutment faces to bring the upper and lower member more closely in alignment in the vertical plane to suit a particular golfer and to balance the club head. The upper and lower members 28 and 30 can also have a set therein to achieve the same purpose. Also a small gap 72 is left between the connector member 52 and the upper face of the head 12 to permit minor pivotal adjustments about the axis of the screw 54. The gap 72 can be filled, eg. by silver soldering, after a desired adjustment is made.

Also in this embodiment, it will be noted that the pivotal connection 18 is closer to the head 12 than in the previous embodiment.

The fantail slot 60 can be filled with material forming an extension of the bulbous portions 66 to increase the mass of the head 12 at its ends. The slot 60 can be filled with inserts at its ends. In a preferred form, the head 12 is cast with the slot 60 closed at one end. An insert (not shown) is then inserted in the opposite end of the slot 60 to balance the club head. The inserts can have arcuately curved inner ends and the member 58 can have correspondingly curved outer ends so that the member 58 can fit matingly into the curved portions of the inserts when the member 58 is at either end of the slot 60.

The fantail shaped member 58 can then enter the slot 60 via a transverse slot 73 leading from the slot 64. The slot 73 also permits the introduction of weights into the slot 60 to balance the head 12.

Also as shown in FIG. 10, the lower rear face of the head 12 has a portion 74 to permit a back handed slot to be played with the rear of the head 12, the portion 74 providing a face which can provide loft thereby allowing a golfer to play a back handed shot to avoid a penalty stroke when a golf ball lands in a difficult position preventing a normal fore handed shot.

The invention illustrated permits a golfer to experiment with the golfing aid until a club of suitable mass, effective length, and so on, has been found. The golfer can record the particular configuration which suits him or her best and a manufacturer can then manufacture a custom built golf club in accordance therewith. If desired, the pivotal connection 18 can be used to form a mould for forging that portion of the golf club. Instead of forging, that portion of the golf club can be formed by machining. Also the golfing aid itself can be converted into a golf club by encapsulation of the various adjustments. It will further be appreciated that the same golfing aid can be used to provide a club for both a left handed and a right handed player. The various adjustments also permit variation of the balance of the club head to suit a particular player.

What I claim is:

1. A golfing aid which comprises a golf club head having a ball-striking surface, a toe and a heel, an elongate shaft and connection means connecting the lower end of the shaft to the club head, the connection means being adjustable to suit the individual preference of a particular player and comprising:

(a) a first member having an upper end and a lower end, the lower end of the shaft being connected to the upper end of the first member;

(b) a second member having an upper end and a lower end, the lower end of the second member being connected to the club head at a connection whose position is adjustable along the club head between the toe and the heel thereof, said connection permitting the second member to be adjusted pivotally relative to the club head about a first axis transverse to the ball-striking surface of the club head; and (c) a third, intermediate member connected to the first member and to the second member, thereby connecting the first and second members indirectly to one another, the connection between the third member and the first member permitting pivotal adjustment of the first member relative to the third member to take place about a second axis, and the connection between the third member and the second member permitting pivotal adjustment of the second member relative to the third member to take place about a third axis, one of the second and third axes being transverse to the first axis and the other being parallel to, but spaced from the first axis, the connections between the shaft and members being fixable after adjustments have been made to suit the player's individual preference, thereby to form a golf club customized for the player.

2. A golfing aid according to claim 1 for forming a putter, wherein the club head is perfectly symmetrical about a central vertical axis, whereby a golf club formed from the golfing aid is suitable both for left-handed and right-handed players.

3. A golfing aid according to claim 2, wherein the golf club head has weight concentrations towards the toe and heel thereof, the weight concentrations being spaced apart from one another by a recess in the rear surface of the club head remote from the ball-striking surface.

4. A golfing aid according to claim 3, wherein the base of the recess is formed with a slot whose depth varies in the toe-heel direction.

5. A golfing aid according to claim 3, wherein said golfing aid is a putter.

6. A golfing aid according to claim 1, wherein the connection between the lower end of the second member and the club head comprises a fantail slot extending in the toe-heel direction and a member which is carried by the second member and which is shaped complementary to the slot, whereby the said member is adjustably positionable at a chosen location along the slot, and wherein the slot has ends which are filled with inserts.

7. A golfing aid according to claim 1, wherein the third member has a cranked shape.

* * * * *